United States Patent [19]

Bradford et al.

[11] 4,202,753

[45] May 13, 1980

[54] REDUCTION CELL HOOD

[75] Inventors: Donald R. Bradford; James E. White, both of Lake Charles, La.

[73] Assignee: Swiss Aluminium Ltd., Chippis, Switzerland

[21] Appl. No.: 32,032

[22] Filed: Apr. 23, 1979

[51] Int. Cl.[2] ..... C25C 3/22

[52] U.S. Cl. ..... 204/247

[58] Field of Search ..... 204/247, 243–246, 204/67

[56] References Cited

U.S. PATENT DOCUMENTS

| | | | |
|---|---|---|---|
| 3,948,749 | 4/1976 | Sargent | 204/243 R |
| 4,002,551 | 1/1977 | Duclaux et al. | 204/247 |
| 4,136,003 | 1/1979 | Arnason et al. | 204/247 |

FOREIGN PATENT DOCUMENTS

| | | | |
|---|---|---|---|
| 2263348 | 7/1974 | Fed. Rep. of Germany | 204/247 |
| 134429 | 4/1960 | U.S.S.R. | 204/243 R |
| 393361 | 12/1973 | U.S.S.R. | 204/243 R |

*Primary Examiner*—John H. Mack
*Assistant Examiner*—D. R. Valentine
*Attorney, Agent, or Firm*—Bachman and LaPointe

[57] ABSTRACT

The present invention provides a highly efficient reduction cell hood which utilizes an improved shield installation which is easily movable by hand thereby allowing for fewer shields which results in a corresponding decrease in the number of joints which must be sealed. The reduction cell hood of the present invention is constructed of a material which is capable of withstanding the operating temperatures of the electrolyte process without warping, buckling or other damage thereto.

6 Claims, 4 Drawing Figures

REDUCTION CELL HOOD

BACKGROUND OF THE INVENTION

The present invention relates to an improved cell hood and more particularly an improved hood for use on an aluminum reduction cell.

In the electrolyte process for the production of aluminum a reduction cell is employed. The reduction cells presently in commercial use vary greatly in both types and size. Most cells in use fall into one of the major categories of Horizontal Stud Soderburg and Vertical Stud Soderburg, which employ self-baking anodes, and Centerwork Prebake and Side Worked Prebake which employ prebaked anodes. Sizes ranges from about 45,000 amperes to 225,000 amperes. The typical cell comprises a hollow pan of carbon which is supported on a bed of insulating material. The carbon pan is provided with embedded steel rods to which current is fed such that the pan acts as a cathode in the reduction cell. The hollow pan is charged with a molten aluminum bath and a charge of the electrolyte comprising molten cryolite ($Na_3AlF_6$) and alumina ($Al_2O_3$) floats on the aluminum layer. One or more carbon anodes are immersed into the molten charge. With the passage of current to the cathode the $Al_2O_3$ is dissolved in the cryolite and is disassociated. In the course of the electrolyte process, various gases such as carbon monoxide and carbon dioxide and particulate matter such as metallic sodium are generated in the reduction cell. In this age of environmental awareness, various developments have been made in the collection and treatment of the aforenoted emissions and treatment systems have been developed in recent years which are highly efficient, as for example, the apparatus disclosed in U.S. Pat. No. 3,470,075 to Johnson.

Currently, the greatest problem presently encountered for the further reduction and elimination of the emissions generated in the electrolyte process lies in the area of designing an efficient collection hood to fit the reduction cell. Known collection hoods, particularly collection hoods for a centerbreak cell, suffer from the disadvantage that they do not seal sufficiently tightly to prevent the escape of a significant percentage of environmentally damaging emissions. Thus, even though emissions extracted from within the hood can be conveyed to highly efficient treatment plants, a significant percentage of emissions leak from the hood and are never treated.

A typical hooding arrangement is disclosed in U.S. Pat. No. 3,948,749. As set forth in said U.S. Pat. No. 3,948,749 traditionally the hood comprised a plurality of removable shields the size and weight of which allowed for convenient and easily removed by hand so as to allow easy access to the cell for inspection and servicing. This requirement for lightweight hand removable shields results in a need for a large number of shields in order to enclose the reduction cell thereby resulting in a corresponding increase in the number of sealing surfaces and sealing joints. In addition, in order to mitigate the effect of high magnetic fields which would occur with steel shields, the magnetic fields increasing the force necessary to remove the shields, and to reduce the weight of the shields, the shields are typically constructed of lightweight aluminum or aluminum alloys. It has been found that the employment of aluminum shields is generally undesirable. The melting temperature of the aluminum shields is less than the operating temperatures of the reduction cell which frequently results in warping of the shields which results in a loss of hooding efficiency as well as a corresponding increase in maintenance costs.

Accordingly, it is the principal object of the present invention to provide an improved reduction cell hood characterized by high collection efficiency.

It is a particular object of the present invention to provide an improved reduction cell hood having a reduced number of joints to be sealed.

It is a further object of the present invention to provide an improved reduction cell hood which is easily movable by hand.

It is a still further object of the present invention to provide an improved reduction cell hood which is not damaged by the high temperatures employed in the cell.

Further objects and advantages will appear hereinbelow.

SUMMARY OF THE INVENTION

In accordance with the present invention, it has been found that the foregoing objects and advantages may be readily obtained.

The present invention provides a highly efficient reduction cell hood which utilizes an improved shield installation which is easily movable by hand thereby allowing for fewer shields which results in a corresponding decrease in the number of joints which must be sealed. The reduction cell hood of the present invention is constructed of a material which is capable of withstanding the operating temperatures of the electrolyte process without warping, buckling or other damage thereto.

In accordance with the present invention, a reduction cell hood is provided with a plurality of shields mounted on rollers in overlapping fashions such that the shields are easily movable by hand to allow for easy access to the cell for inspection and servicing. By employing shields which are easily movable, the number of shields required to enclose the cell is greatly reduced thereby resulting in a corresponding reduction in the number of joints which must be sealed to prohibit emissions. Furthermore, by allowing for each movable shields, the material that the shields are constructed of can withstand cell operating temperatures thereby eliminating warping and buckling which results in reduced hood efficiency.

Accordingly, the hood of the present invention overcomes those disadvantages of reduction cell hoods heretofore known.

DETAILED DESCRIPTION

Figure 1:
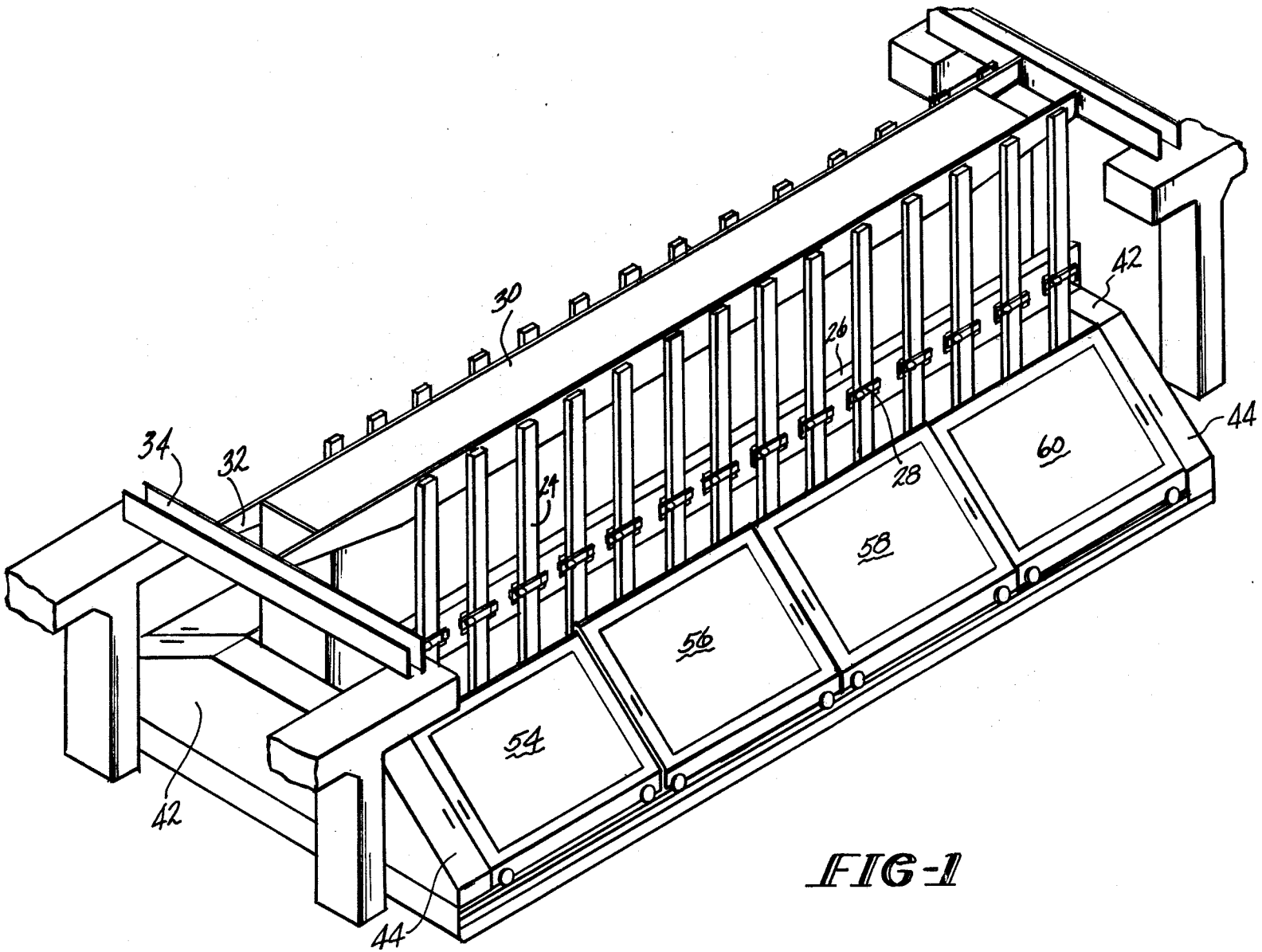
FIG. 1 is a perspective view of an aluminum reduction cell illustrating the arrangement of the sliding axis plates of the cell hood of the present invention.
Figure 2:
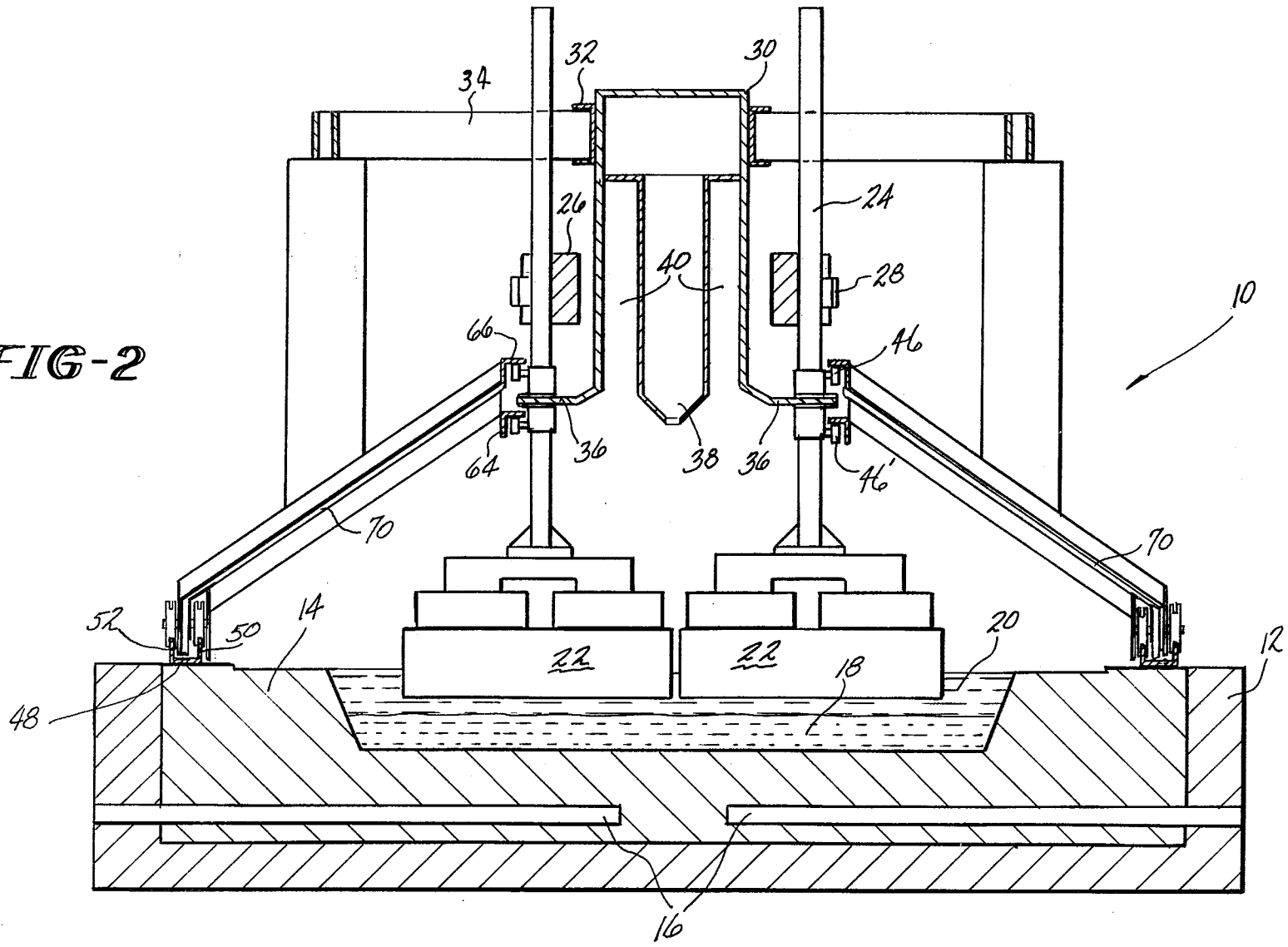
FIG. 2 is a cross sectional view through the aluminum reduction cell as shown in FIG. 1.
Figure 3:
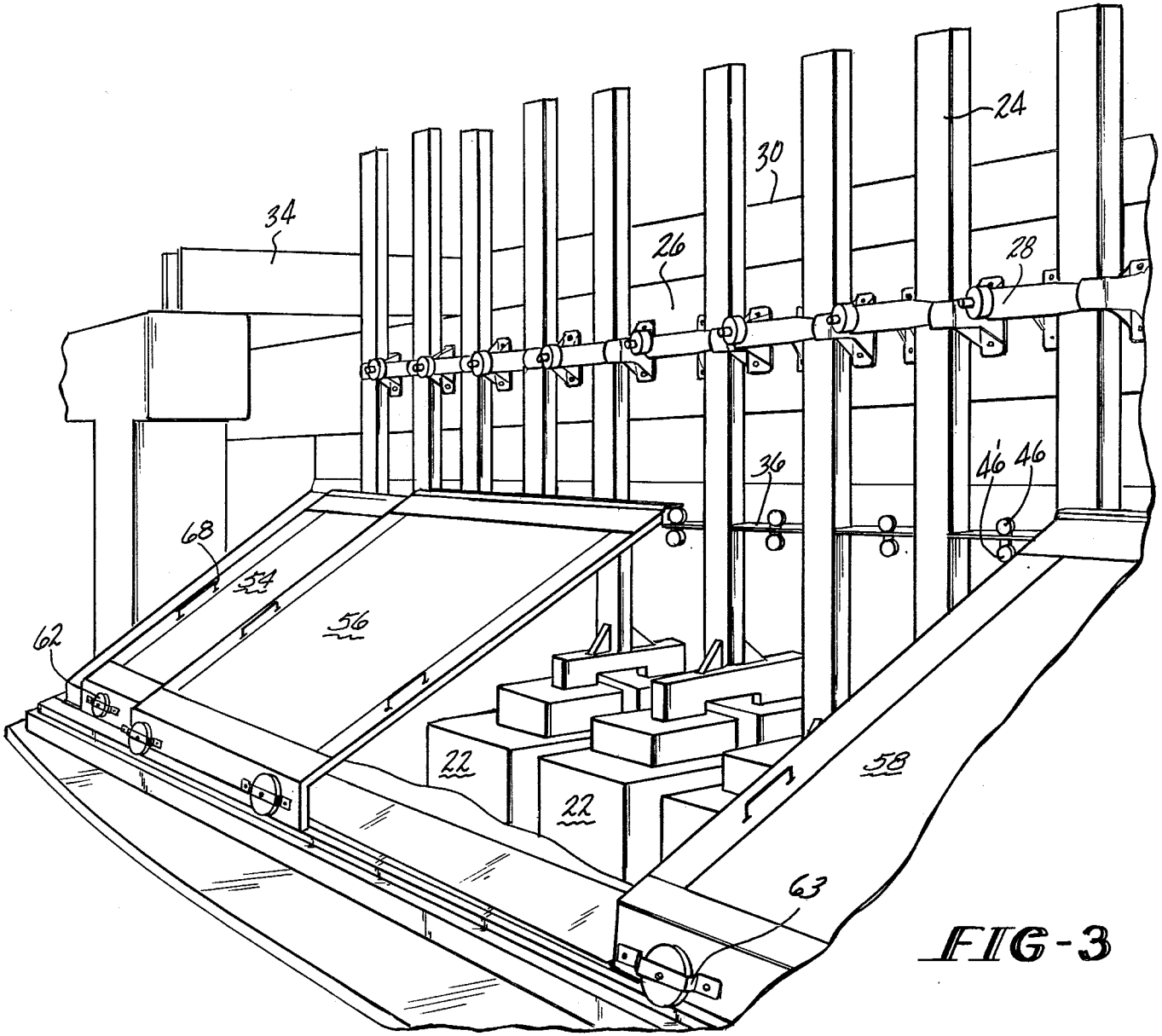
FIG. 3 is a partially perspective side view of the reduction cell of FIG. 1 illustrating the hood shields of the present invention.

Referring to FIGS. 1-3, a reduction cell 10 is illustrated comprising a bed 12 of insulating material enveloping a pan 14 of carbon which forms the cathode of the reduction cell. An electrical connection is made to the pan 14 by means of embedded rod 16. The pan 14 holds a molten metal bath 18 formed from reduced alumina on which an electrolyte 20 is disposed.

The reduction cell 10 is provided with a plurality of carbon anodes 22 immersed in the electrolyte 20. The anodes are suspended from bars 22 secured to bus bars 26 by clamping means 28. An electrical connection to the anodes 22 is made by the bus bars 26 clamped against bars 24 by clamping means 28 which permit individual adjustment of the anodes 22. Any suitable means, not shown, may be employed for raising and lowering the bus bars 26 and thereby the anodes 22, such as screw threads or the like. A hopper 30 is provided over the reduction cell 10 and is secured to rails 32 by any suitable manner which in turn are fixed to support 34 for supporting the hopper 30 over the reduction cell 10. The hopper 30 is provided with a notched steel skirt 36 mounted under bus bars 26 and rigidly fastened to said hopper or integral therewith for reasons to be explained in more detail hereinbelow. The hopper 30 is used to supply alumina to the cell through opening 38. Ducts 40 are disposed on either side of hopper opening 38 for drawing off the gases evolved during the reduction process.

The foregoing description is believed to sufficiently set forth the general construction of an aluminum reduction cell for purposes of discussing the cell hood structure of the present invention.

In accordance with the present invention, steel end shields 42 are fixedly installed on the end of the reduction cell bed 12 and comprise hinged inspection doors 44 which allow for access to the reduction cell 10. Steel skirt 36 is rigidly fixed to hopper 30 and mounted under the movable bus bars 26 and extend between the fixed end shields 42. As can best be seen in FIG. 3, the fixed steel skirt 36 is provided with a plurality of notched recesses through which bars 24 from which the anodes 22 suspend pass through. Mounted on steel skirt 36 between the bars 24 are a pair of rollers 46 and 46', one of which lies in a plane above the plane of the skirt 36 and the second of which lies in a plane below the plane of the skirt 36 and forms with the first roller a plane which is substantially perpendicular to the plane of the skirt 36.

Figure 4:
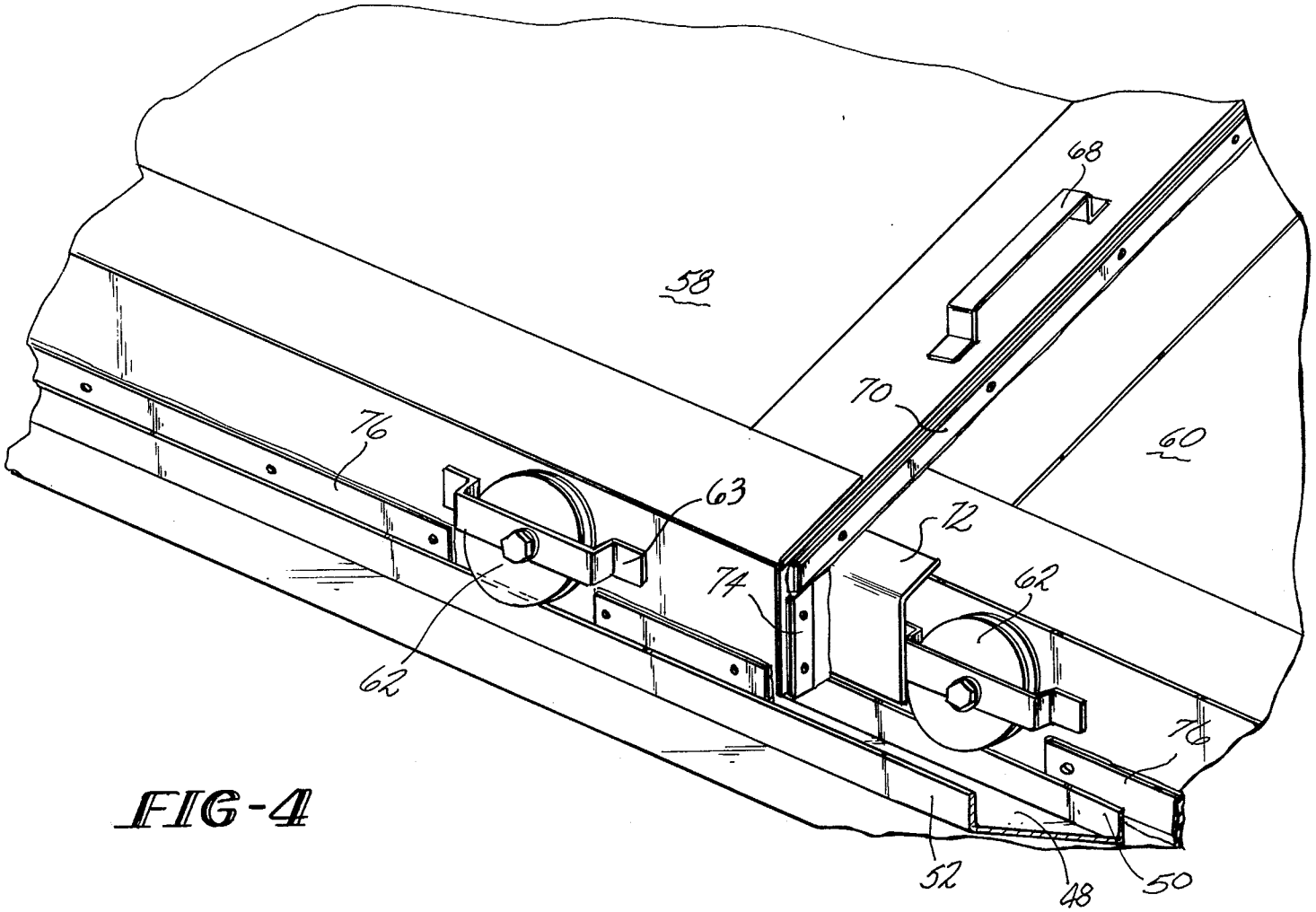
FIG. 4 is an enlarged perspective side view showing the details of the sliding hood shields of the present invention.

As can best be seen in FIG. 4, mounted on cathode pan 14 on both sides of reduction cell 10 and extending between steel end shield 42 are track means 48 which comprise an inner track 50 and an outer track 52 of raised steel extending the full length of the reduction cell 10. Four steel shields 54, 56, 58 and 60, respectively are installed on each side of the cell. Two of the shields, 54 and 60, respectively, are provided on their bottom end with a pair of grooved wheels 62 mounted to the plates 54 and 60 by electrical insulation members 63 and are adapted to roll on the inside track means 48. As can be seen in FIG. 3 on the upper end of the steel shields 54 and 60 is fastened an aluminum angle 64 which is adapted to ride on lower rollers 46' secured to steel skirt 36. Steel shields 56 and 58 are provided with grooved wheels 62 in the same manner as described with regard to shields 54 and 60, the wheels being adapted to mate with outer track 52 on track means 48. Likewise, the upper end of each of the shields 56 and 58 are provided with an aluminum angle 66 fastened thereto which ride on upper rollers 46 secured to steel skirt 36. Handles 68 are provided on each of the shields 54, 56, 58 and 60, respectively, so as to allow for easy movement of the same.

Regardless of the size of the reduction cell, it is only necessary that a total of four shields be installed on each side of the cell. Since the shields are rolled sideways for cell servicing and do not require that they be manually removed the weight of the shield is of little importance. In addition, since the shields do not have to be removed from the cell but merely rolled sideways the magnetic fields between the shields and the cell has little effect on moving the same and therefore the shields can be of heavy and strong steel construction. The arrangement of two inner shields 54 and 60 and two outer shields 56 and 58 allows up to 50% of the side of the reduction cell to be exposed at any one time for servicing. As can best be seen in FIG. 4, the overlapping relation of the inner and outer shields, for example 58 and 60 as shown in FIG. 4, enables an easy sealing joint. The outer shield 58 is provided on the end thereof with a flexible gasket material 70 such as asbestos cloth, silicon rubber or silicon fiber cloth. The flexible gasket 70 on the outer shields 56 and 58, respectively, seal against the inner shields 54 and 60. In addition, the inner shields 54 and 60 are provided with a flanged member 72 on which a second flexible gasket seal 74 secured to the outer shields 56 and 58 rests against. In addition to the foregoing, the legs of shields 54, 56, 58 and 60 on which the grooved wheels are secured are provided with additional flexible gasket material 76 secured thereto which seals against the respective inner and outer tracks 50 and 52 of track assembly 48. Thus, it can be seen that the sliding shields of the hood of the instant invention are effectively sealed on their overlapping joints as well as the joints formed with the track assembly 48. The butt joint between the outer shields 56 and 58 and the butt joint between inner shields 54 and 60 and the fixed steel end shields 42 are tightly sealed by the magnetic field effect produced in the steel shields. It should be appreciated that the force of the metal attraction of the shields between the aforenoted butt joints may be adjusted by installing a continuous thin strip (not shown) of non-magnetic material such as aluminum, brass or stainless steel between the butt joints so that the force of attraction is sufficiently strong so as to tightly seal the joints and yet not so strong as to prevent the joints from being broken by hand movement by an individual.

Thus, it can be seen that the present invention provides a highly efficient reduction cell hood which utilizes an improved shield installation which is easily movable by hand thereby allowing for fewer shields which results in a corresponding decrease in the number of joints which must be sealed. In addition, the reduction cell hood of the present invention is able to be constructed of steel material which is capable of withstanding the operating temperatures of the electrolyte process without warping, buckling or other damage thereto.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

We claim:

1. In an alumina reduction cell having a pan containing a bath of molten electrolyte, a steel skirt supported over said bath and a plurality of carbon anodes disposed in said bath, the improvement comprising:

a first and second plurality of shields each having a first and a second spaced apart end face arranged to form a lateral enclosure along said cell;

track means mounted on said pan, said track means comprising a first outer track and a second inner track spaced from and parallel to said first outer track, said tracks extending the entire length of said cell; and wherein said shields are slidably mounted on said cell and include a flexible gasket secured thereto for sealing the gap between said shields and said track means.

2. In an alumina reduction cell having a pan containing a bath of molten electrolyte, a steel skirt supported over said bath and a plurality of carbon anodes disposed in said bath, the improvement comprising:

a first and second plurality of shields each having a first and a second spaced apart end face arranged to form a lateral enclosure along said cell;

track means mounted on said pan, said track means comprising a first outer track and a second inner track spaced from and parallel to said first outer track, said tracks extending the entire length of said cell;

roller means mounted on said skirt, said roller means comprising a first group of rollers secured to said skirt at a first height and a second group of rollers secured to said skirt at a second height below said first height;

first wheel means connected to said first plurality of shields and adapted to ride on said first outer track means;

second wheel means connected to said second plurality of shields and adapted to ride on said second inner track means;

first flange means connected to said first plurality of shields and adapted to ride on said first group of rollers;

second flange means connected to said second plurality of shields and adapted to ride on said second group of rollers; and sealing means secured to one of said end faces of said first plurality of shields wherein said first and said second plurality of shields are manually slidable on said track means and said roller means for exposing a portion of said cell whereby said first plurality of shields is slidable over said second plurality of shields and said sealing means seals the gap between said first and second plurality of shields whereby said other of said end faces of said first plurality of shields abut each other in their closed position.

3. An apparatus according to claim 2 wherein said shields are made of steel and said angle flanges are made of aluminum.

4. An apparatus according to claim 2 wherein said shields include a flexible gasket secured thereto for sealing the gap between said shields and said first outer track and said second inner track.

5. An apparatus according to claim 2 wherein said end faces of said first plurality of shields which abut each other are sealingly held together by magnetic forces.

6. An apparatus according to claim 2 wherein said second plurality of shields are provided with flange members adapted to sealingly mate with said sealing means.

* * * * *